US005086601A

United States Patent [19]

Galowitz et al.

[11] Patent Number: 5,086,601

[45] Date of Patent: Feb. 11, 1992

[54] JOINT STRUCTURE

[75] Inventors: Dennis A. Galowitz, Stillwater, Minn.; Harold H. Evans, Hudson, Wis.

[73] Assignee: Andersen Corporation, Bayport, Minn.

[21] Appl. No.: 545,113

[22] Filed: Jun. 27, 1990

Related U.S. Application Data

[63] Continuation of Ser. No. 301,173, Jan. 24, 1989, abandoned.

[51] Int. Cl.[5] ..... E04C 2/38

[52] U.S. Cl. ..... 52/656; 52/586; 52/418

[58] Field of Search ..... 52/656

[56] References Cited

U.S. PATENT DOCUMENTS

| | | | |
|---|---|---|---|
| 228,052 | 5/1880 | Frost . | |
| 262,148 | 8/1882 | Stuart | 52/656 |
| 479,010 | 7/1892 | Muhle . | |
| 540,501 | 6/1895 | Lanyon . | |
| 541,450 | 6/1895 | Wright | 52/656 |
| 921,114 | 5/1909 | Hudson . | |
| 1,098,405 | 6/1914 | Reinecke | 52/656 |
| 1,391,602 | 9/1921 | Abramson . | |
| 1,825,195 | 9/1931 | McAvoy et al. . | |
| 1,909,791 | 5/1933 | Welch . | |
| 2,158,082 | 1/1937 | Morrell | 72/1 |
| 2,366,108 | 12/1944 | Hitchins | 20/2 |
| 2,473,728 | 6/1949 | Rutledge | 52/586 |
| 2,844,848 | 7/1958 | Couse et al. | 52/586 |
| 3,025,640 | 3/1962 | Muhr | 50/186 |
| 3,126,671 | 3/1964 | Nagel | 50/128 |
| 3,170,201 | 2/1965 | Nofziger | 52/586 |
| 3,172,508 | 3/1965 | Doering et al. | 52/594 |
| 3,197,933 | 8/1965 | Burns et al. | 52/418 |
| 3,283,301 | 11/1964 | Kent et al. | 211/41 |
| 3,535,204 | 10/1970 | Truxa | 52/586 |
| 3,885,882 | 5/1975 | Curti | 403/297 |
| 4,381,324 | 4/1983 | Ellingson, Jr. | 428/58 |
| 4,404,782 | 9/1983 | Williams et al. | 52/475 |
| 4,677,797 | 7/1987 | Roth | 52/94 |

OTHER PUBLICATIONS

Fine Wood Working on Joinery—Entry Doors by Ben Davis, pp. 56–59; 1987.

Wood Joints from Architectural Graphic Standards by Charles G. Ramsey and Harold R. Sleeper, p. 254; 1970.

*Primary Examiner*—David A. Scherbel
*Assistant Examiner*—Wynn E. Wood
*Attorney, Agent, or Firm*—Merchant, Gould, Smith, Edell, Welter & Schmidt

[57] ABSTRACT

The present invention is a joint structure which is particularly adapted for the construction of a frame for windows and doors. The joint structure includes a tenon which is cooperatively connected to a first portion at a mortise which is formed in a second portion. The mortise is positioned and sized to receive the tenon. A first groove is formed in the tenon and is transverse to the tenon. A second groove is formed in the second portion wherein when the tenon is inserted into the mortise, the second groove is aligned with the first groove to form a dowel cavity. A locking dowel pin is inserted into the dowel cavity and provides a resistance to sheer force along substantially the length of the pin.

8 Claims, 2 Drawing Sheets

FIG. 1
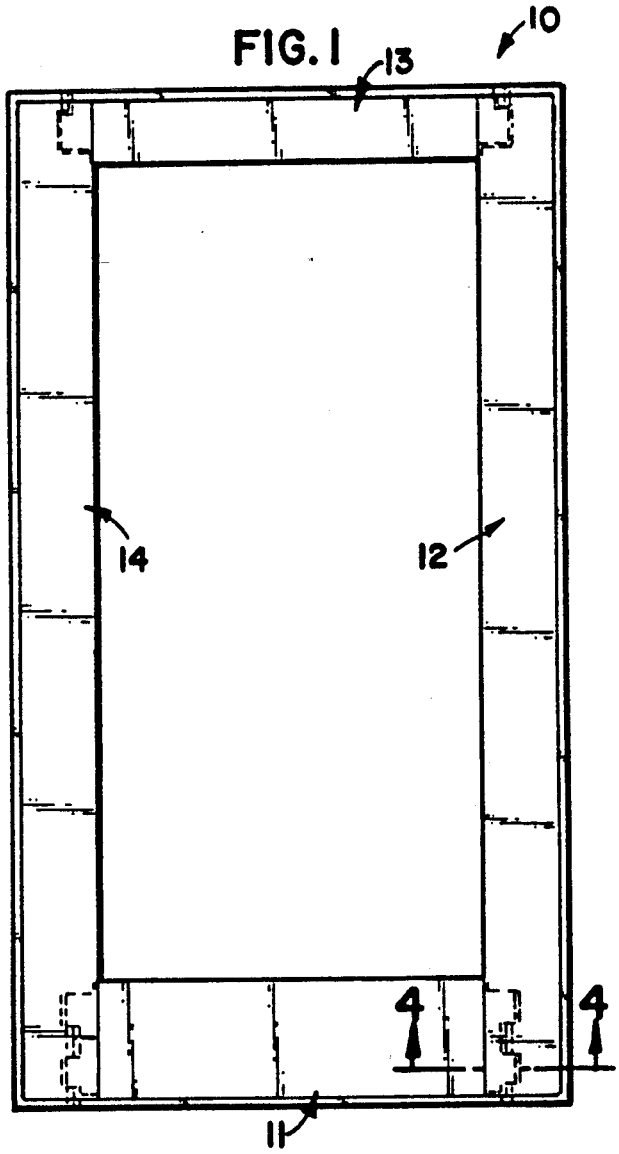
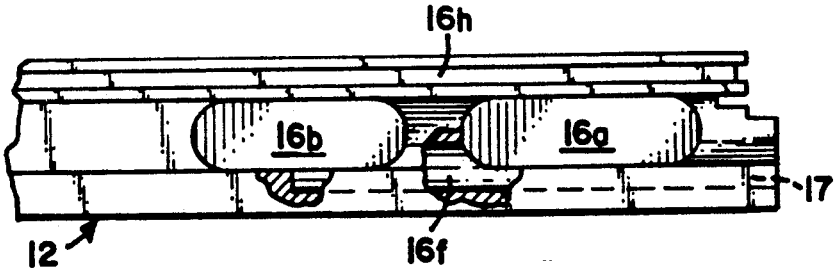
FIG. 5
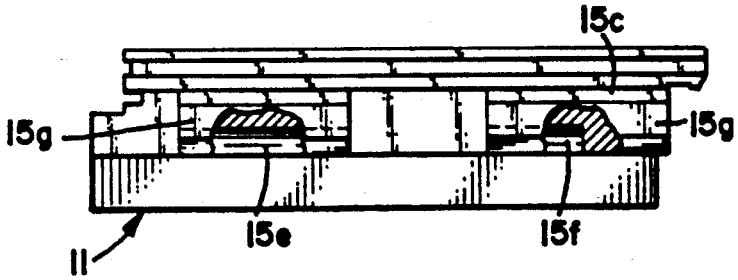
FIG. 6

FIG. 3
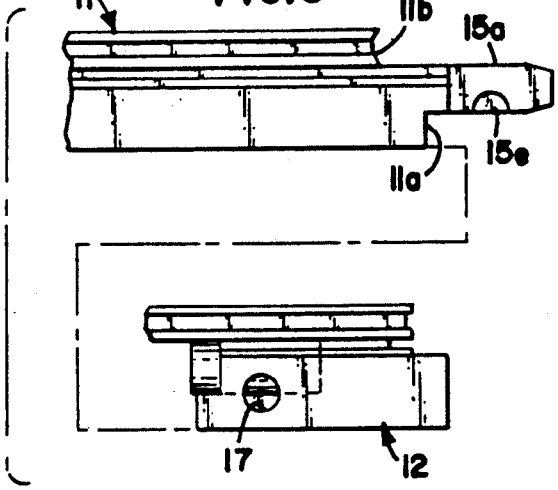
FIG. 4
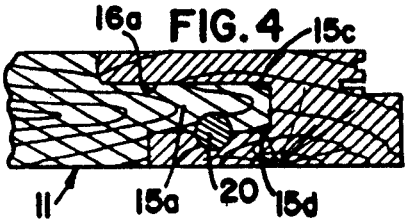
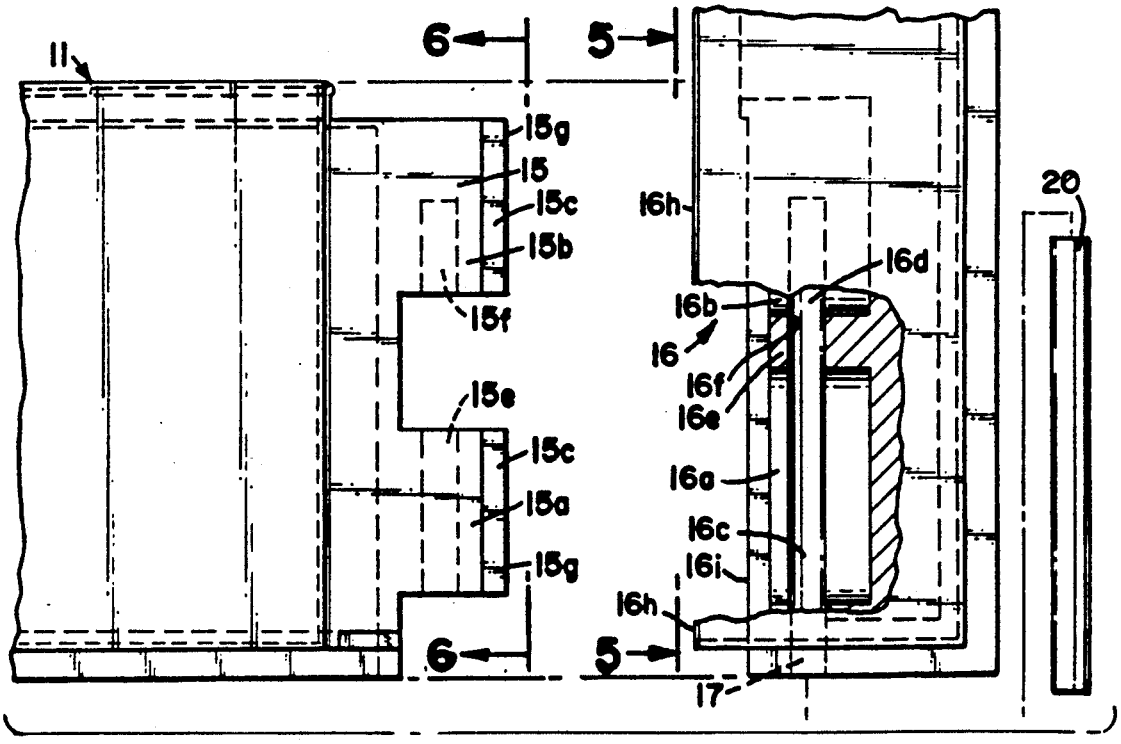
FIG. 2

JOINT STRUCTURE

This is a continuation of application Ser. No. 07/301,173, filed Jan. 24, 1989, which was abandoned upon the filing hereof.

BACKGROUND OF THE INVENTION

1. Field of the Invention

This invention relates generally to an improved joint structure for interconnecting first and second portions and more particularly relates to a mortise and tenon joint structure having a locking dowel pin, the joint structure being utilized for the construction of the frame.

2. Description of the Prior Art

Throughout the years, many methods of joining two pieces of material to form a joint have been utilized. With respect to wooden frames, such as windows and doors, many of the typical wood joints have been used. These wood joints include rabbet, dado and mortise and tenon. There are of course other joints and combinations thereof which have been utilized.

In the construction of certain frames for doors, it is becoming more and more important to eliminate any racking which may occur between two sections of a frame that are joined. Racking of the door frame will cause a change in the dimensions of the door frame and result in a deterioration of the weatherstripping provided for the door.

The present invention addresses the problems associated with the prior art joint structures and provides for an improved joint structure which provides for a strong joint between first and second portions.

SUMMARY OF THE INVENTION

The present invention is a joint structure for interconnecting first and second portions. A tenon is cooperatively connected to the first portion and a mortise is formed in the second portion. The mortise is positioned and sized to receive the tenon. A first groove is formed in the tenon. The first groove is transverse to the tenon. A second groove is formed in the second portion, wherein when the tenon is inserted into the mortise, the second groove is aligned with the first groove to form a dowel cavity. A locking dowel pin is inserted into the dowel cavity, wherein when inserted in the dowel cavity, the pin further secures the tenon in the mortise and provides a resistance to a sheer force along substantially the length of the pin.

The joint structure of the present invention may be utilized in a multitude of construction, but is particularly adapted for being utilized in the construction of a frame for windows and doors. When used in the construction of a frame, one or more joint structures may be utilized in the frame construction.

BRIEF DESCRIPTION OF THE DRAWINGS

FIG. 1 is a front elevational view of a frame utilized in the joint structure of the present invention.

FIG. 2 is an exploded front elevational view of the joint structure used in the frame shown in FIG. 1.

FIG. 3 is an exploded bottom elevational view of the joint structure shown in FIG. 2.

FIG. 4 is a cross-sectional view of the joint structure shown in FIG. 1, taken generally along the lines 4—4.

FIG. 5 is a partial front elevational view taken along the lines 5—5.

FIG. 6 is a partial front elevational view taken along the lines 6—6.

DETAILED DESCRIPTION OF THE INVENTION

Referring to the figures, wherein like numerals represent like parts throughout the several views, there is generally disclosed at 10, a frame. The frame 10 includes a first portion 11, second portion 12, third portion 13, and fourth portion 14, cooperatively connected to form the frame 10. The portions, as shown in FIG. 1, are all cooperatively connected by the joint structure of the present invention. However, it is appreciated that the joint structure of the present invention may be used on less than all four of the interconnections between the portions. Because of the solid construction available from the joint structure of the present invention, applicant has found that if the joint structure is not to be used on all four of the interconnections of a typical door frame, it should at least be used to connect the bottom portion 11, where racking can cause the most problems. The portions 11 through 14 are wooden and alternately may have a vinyl coating adhered to their outside surfaces, by means well known in the art.

FIG. 2 shows an exploded front elevational view of the joining of portions 11 and 12. The first portion 11 has a tenon 15 formed as an integral portion of the first portion 11 at one end. The double tenon 15 has two sections, **15*a* and 15*b*. The top surface of the tenon 15 has a chamfered edge 15*c* and the bottom surface has a chamfered edge 15*d*. The chamfered edges 15*c* and 15*d* allow for easier insertion into the mortise, as will be discussed more fully hereafter. A groove 15*e* is formed in the first section 15*a*, and groove 15*f* is formed in the second section 15*b*. The grooves 15*e* and 15*f* are in axial alignment. The grooves 15*e* and 15*f* are transverse to the tenon 15. Further, groove 15*e* extended the width of 15*a* but groove 15*f* extends approximately ½ the width of 15*b*, but it is understood that groove 15*f* could extend either more of less of the width of section 15*b*. The grooves 15*e* and 15*f* have a cross section which is generally hemispherical. An undercut 11*a* is formed proximate the bottom surface of the first portion 11 to form a notched area. The tenon 15 has a leading edge 15*g*. Another cut 11*b* is formed proximate the top surface of the first portion 11 to define a second notched area in the first portion 11**.

The second portion 12 of the frame 10 has formed therein a double mortise 16. The mortise 16 is sized to receive the tenon 15 and to have a friction fit therebetween. The width of the tenon sections **15*a* and 15*b* may be less than the width of the cavities 16*a* and 16*b*, but it is the height of the sections and cavities that form the friction fit. The mortise 16 includes a first cavity 16*a* and a second cavity 16*b*. As shown in FIGS. 2 and 5, first groove 16*c* is formed in the first portion 12 proximate the bottom of the first cavity 16*a* and is transverse thereto. A second groove 16*d* is formed in the second portion 12 proximate the bottom of the second cavity 16*b* and is transverse thereto. The grooves 16*c* and 16*d* are in axial alignment with each other. The bridge 16*e*, which is positioned between the cavities 16*a* and 16*b* has a longitudinal bore 16*f* through it. The bore 16*f* is in alignment with the grooves 16*c* and 16*d*. An insertion bore 17 is formed in the mortise 16 and extends from the outer surface into the first cavity 16*a*. The bore 17 is in alignment with the groove 16*c* such that the bore 17, groove 16***c*, bore 16*f* and groove 16*d* are in alignment and form one continuous groove.

In constructing the frame 10, the first portion 11 is positioned proximate the second portion 12 and the double tenon 15 is inserted into the double mortise 16. The chamfered edge 15*g* of the tenon 15 guides the tenon into the cavities 16*a* and 16*b*. The first portion 15 is inserted until the leading edge 16*h* of the mortise 16 comes in contact with the notched area 11*b*. At the same time that the leading edge 16*h* contacts the notched area 11*b*, the bottom leading edge 16*i* comes in contact with the notched area 11*a*. When so assembled, the hemispherical groove 15*e* is positioned over the hemispherical groove 16*c* and the hemispherical groove 15*f* is positioned over the hemispherical groove 16*d*. The grooves thereby form a cylindrical bore which is in axial alignment with the bores 16*f* and 17. Together, the grooves 15*e*, 16*c*, 15*f* and 16*d* form a dowel cavity. A dowel pin 20 has a cross section which is in a similar configuration to the cross section of the bores 17 and 16*f* and also the cavities formed by the pairs of grooves 15*e* and 16*c*; and 16*d* and 15*f*. The dowel pin is inserted into the dowel cavity, wherein when inserted into the dowel cavity, the pin 20 secures the tenon 15 into the mortise 16 and provides for resistance to a shear force along substantially the length of the pin 20. There is a tight friction fit between the pin 20 and the dowel cavity to provide for a secure fit. In addition, glue or adhesive may be used in conjunction with the pin 20 and also in conjunction with the tenon sections 15*a* and 15*b* and the cavities 16*a* and 16*b*.

While the foregoing describes the groove in the tenon mortise being made separately, such as by routing or milling, it is also understood that the dowel cavity may simply be formed by inserting the mortise into the tenon and then making one drill hole to simultaneously form the two grooves which combine to make the dowel cavity.

The specific embodiment of the frame shown in FIG. 1 a double tenon 15 at its base. It is understood that only a single tenon may be utilized, and in fact this is shown as the joint used at the top portion of the frame 10. The specific configuration and construction of the single mortise and tenon is not detailed as one skilled in the art could easily utilize only the first tenon 15*a* as specifically described. However, when a single tenon is utilized, the stile will not be unhanded. The use of a double mortise allows the stile to be unhanded.

In addition, the split tenon or double mortise reduces the shrinkage which will occur with wood products. By having a smaller amount of shrinkage, the glue or adhesive which may be used in conjunction with this joint also receives less sheer force and tends to create a better bond.

Finally, applicant has found that if all of the parts are treated and coated in a knocked down condition, a better joint is ultimately formed.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

I claim:

1. A joint structure for interconnecting first and second portions of a frame for a door or window, comprising:

(a) a tenon cooperatively connected to a first portion of the frame;

(b) a mortise formed in a second portion of the frame, the mortise position being sized to receive the tenon;

(c) a first groove formed in the tenon, the first groove being transverse to the tenon;

(d) a second groove formed in the second portion, wherein when the tenon is inserted in the mortise, the second groove is aligned with the first groove to form a dowel cavity; and (e) a locking dowel pin for insertion into the dowel cavity, wherein when inserted in the dowel cavity the pin further secures the tenon in the mortise and provides a resistance to a shear force along substantially the length of the pin.

2. The joint structure of claim 1, wherein said pin has a circular cross-section.

3. The joint structure of claim 1, wherein said first and second grooves have a hemispherical cross-section.

4. A joint structure for interconnecting first and second portions of a frame for a window or door, comprising;

(a) a tenon cooperatively connected to a first portion of the frame;

(b) a mortise formed in a second portion of the frame the mortise positioned and sized to receive the tenon;

(c) a first groove formed in the tenon, the first groove being transverse to the tenon and the first groove having a hemispherical cross-section;

(d) a second groove formed in the second portion, the second groove having a hemispherical cross-section wherein when the tenon is inserted in the mortise, the second groove is aligned with the first groove to form a dowel cavity having a circular cross-section; and (e) a locking dowel pin for insertion into the dowel cavity, said dowel locking pin having a circular cross-section wherein when inserted in the dowel cavity the pin further secures the tenon in the mortise and provides a resistance to a shear force along substantially the length of the pin.

5. A frame for a door comprising:

(a) a first, second, third, and fourth portions cooperatively connected to form a frame; and (b) a joint structure for interconnecting the first and second portions, comprising:

(i) a tenon cooperatively connected to a first portion;

(ii) a mortise formed in a second portion, the mortise positioned and sized to receive the tenon;

(iii) a first groove formed in the tenon, the first groove being transverse to the tenon;

(iv) a second groove formed in the second portion, wherein when the tenon is inserted in the mortise, the second groove is aligned with the first groove to form a dowel cavity; and (v) a locking dowel pin for insertion into the dowel cavity, wherein when inserted in the dowel cavity the pin further secures the tenon in the mortise and provides a resistance to a shear force along substantially the length of the pin.

6. The frame of claim 5, wherein said pin has a circular cross-section.

7. The frame of claim 5, wherein said first and second grooves have a hemispherical cross-section.

8. A joint structure for interconnecting first and second portions of a frame for a door or window, comprising:

(a) a tenon cooperatively connected to the first portion of the frame;

(b) a mortise formed in the second portion of the frame, the mortise being sized to receive the tenon; and (c) a locking dowel pin for insertion into a dowel cavity formed between the tenon and the mortise, wherein when inserted in the dowel cavity, the pin secures the tenon in the mortise and provides a resistance to a shear force along substantially the length of the pin.

* * * * *

UNITED STATES PATENT AND TRADEMARK OFFICE

CERTIFICATE OF CORRECTION

PATENT NO. : 5,086,601

DATED : February 11, 1992

INVENTOR(S) : Galowitz et al.

It is certified that error appears in the above-identified patent and that said Letters Patent is hereby corrected as shown below:

At column 3, line 13, after the word "over", please insert --, and in facing alignment with,--.

At column 3, line 15, after the word "over", please insert --, and in facing alignment with,--.

At column 3, line 18, after the word "cavity", please insert --transverse to the tenon--.

At column 4, line 13, please delete the word "aligned", and instead insert --in facing alignment--.

At column 4, line 14, after the word "cavity", please insert --transverse to the tenon--.

At column 4, line 38, please delete the word "aligned", and instead insert --in facing alignment--.

At column 4, line 40, after the words "cross-section", please insert --transverse to the tenon--.

At column 4, line 60, please delete the word "aligned", and instead insert --in facing alignment--.

UNITED STATES PATENT AND TRADEMARK OFFICE

CERTIFICATE OF CORRECTION

PATENT NO. : 5,086,601

DATED : February 11, 1992

INVENTOR(S) : Galawitz et al

It is certified that error appears in the above-indentified patent and that said Letters Patent is hereby corrected as shown below:

At column 4, line 61, after the word "cavity", please insert --transverse to the tenon--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*